US007670666B2

(12) United States Patent
Deguchi

(10) Patent No.: US 7,670,666 B2
(45) Date of Patent: Mar. 2, 2010

(54) CLOTH

(75) Inventor: Junko Deguchi, Kyoto (JP)

(73) Assignee: Asahi Kasei Fibers Corporation, Osaka-Shi (JP)

( * ) Notice: Subject to any disclaimer, the term of this patent is extended or adjusted under 35 U.S.C. 154(b) by 926 days.

(21) Appl. No.: 10/518,393

(22) PCT Filed: Jun. 19, 2003

(86) PCT No.: PCT/JP03/07817

§ 371 (c)(1),
(2), (4) Date: Dec. 17, 2004

(87) PCT Pub. No.: WO04/001112

PCT Pub. Date: Dec. 31, 2003

(65) Prior Publication Data

US 2005/0126229 A1 Jun. 16, 2005

(30) Foreign Application Priority Data

Jun. 21, 2002 (JP) ..... 2002-181711
Apr. 23, 2003 (JP) ..... 2003-118962

(51) Int. Cl.
*A41D 7/00* (2006.01)
*B32B 3/30* (2006.01)

(52) U.S. Cl. ..... 428/141; 2/67

(58) Field of Classification Search ..... 428/141; 2/67

See application file for complete search history.

(56) References Cited

U.S. PATENT DOCUMENTS 4,956,878 A * 9/1990 Boynton ..... 2/67
4,972,522 A * 11/1990 Rautenberg ..... 2/67
5,033,116 A * 7/1991 Itagaki et al. ..... 2/67
5,836,016 A * 11/1998 Jacobs et al. ..... 2/69
5,887,280 A * 3/1999 Waring ..... 2/69
6,647,550 B1 * 11/2003 Matsuzaki et al. ..... 2/67
2002/0152531 A1 * 10/2002 Fusco et al. ..... 2/2.15

FOREIGN PATENT DOCUMENTS

| | | |
|---|---|---|
| EP | 0 414 497 A2 | 2/1991 |
| EP | 1 152 079 A1 | 11/2001 |
| JP | 5-38006 | 9/1993 |
| JP | 7-279038 | 10/1995 |
| JP | 9-295367 | 11/1997 |
| JP | 9-316757 | 12/1997 |
| JP | 10-298854 | 11/1998 |
| JP | 11-107015 | 4/1999 |
| JP | 11-152610 | 6/1999 |
| WO | WO 00/78544 A | 1/2000 |

* cited by examiner

*Primary Examiner*—William P Watkins, III
(74) *Attorney, Agent, or Firm*—Finnegan, Henderson, Farabow, Garrett & Dunner, L.L.P.

(57) ABSTRACT

A fabric for clothes that has a decreased flow resistance shows a compression ratio of a micro-area in the fabric surface, on the surface side opposite to a body, of from 8 to 90%, and has streaky protruded portions on the surface side opposite to body. The protruded portions preferably have a width of 100 to 2,500 mm, and a height of 30 to 300% of the width of the protruded portions. Moreover, the protruded portions are preferably wavy, streaky ones in one direction on the surface side opposite to a body.

13 Claims, No Drawings

CLOTH

FIELD OF THE INVENTION

The present invention relates to a fabric that shows a decreased resistance to a flow of a fluid such as water or air.

BACKGROUND ART

In the field of sportswear for racing, in which athletes struggle against each other to achieve a higher speed, various attempts have been made to decrease the resistance of the fabric itself to a flow of a fluid such as water and air, and the resistance of sportswear, etc., to a flow of a fluid by the design of the sportswear, etc. Making a fabric surface smooth has heretofore been known as means for decreasing the resistance of the fabric itself to water and air. For example, for a fabric used for racing swimwear, or the like, typical examples of the method of decreasing resistance to fluid such as water and air by smoothing the fabric surface include a method comprising pressing the fabric with a heat calendar roll or a hot plate, and a method comprising laminating a film, etc., to the fabric.

For example, Japanese Unexamined Patent Publication (Kokai) No. 7-279038 describes a fabric that is coated with a metallic thin film layer and subjected to resin treatment in addition to pressing with a heat calendar roll and that shows a very small standard deviation of surface roughness.

Japanese Unexamined Patent Publication (Kokai) Nos. 3-137203, 3-137204, 7-243104, 8-246209, 9-31721, 11-152610, and the like, describe a fabric the fluid resistance of which is decreased by providing the fabric with grooves and projections in a direction parallel to a fluid flow so that the fluid flow is made smooth.

Furthermore, Japanese Patent Publication No. 2711807, Japanese Unexamined Patent Publication (Kokai) No. 8-311751, Japanese Patent Publication No. 3283404, and the like, describe a method that combines a procedure of making a fabric water-repellent and a procedure of making the fabric non-water repellent so that the eddy resistance between fluid and the fabric is decreased.

Although all of the above conventional technologies consider the action of a fabric on a fluid, they do not consider the action of fluid exerted on a fabric, that is, they do not consider deformation of a fabric caused by fluid pressure. The following fabric has never been considered: a fabric designed to decrease a fluid resistance while a flow velocity of fluid in racing, in which athletes struggle against each other to get a higher speed, namely, a fabric deformation caused by fluid under a considerable pressure, is taken into consideration.

Furthermore, a method of decreasing resistance of fluid by making the fluid smooth in the direction parallel to the fluid flow has been known. However, when the fabric is provided with linear streaky unevenness parallel to the fluid flow, the size of an eddy generated increases because the path of the fluid proceeding on the fabric increases. Therefore, apprehensions about an increase in the fluid resistance are feared. The following fabric has never been found: a fabric designed to decrease fluid resistance that is exerted thereto in directions other than the fluid flow direction while the fabric is assumed to be actually worn and while wearer's motion in considerably random directions during wearer's practicing athletic sports, for example, wearer's hand motion during crawling in swimming is taken into consideration.

DISCLOSURE OF THE INVENTION

A problem to be solved by the present invention is to obtain a fabric having a still lower resistance, to fluid such as air and water, than fabrics obtained by conventional technologies. An object of the present invention is to provide a fabric that is designed while deformation of the fabric caused by fluid, and wearer's body motions in considerably random directions during wearer's body movements, are taken into consideration.

As a result of carrying out investigations to solve the above problems, the present inventors have discovered that the compression ratio when compressing a micro-area in a surface of a fabric and the surface roughness of the fabric are related to the deformation thereof caused by fluid such as water and air, and the present invention has thus been achieved.

That is, the present invention is explained below.

1. A fabric for clothes showing a compression ratio of a micro-area in the fabric surface on the surface side opposite to a body of from 8 to 90%, and having streaky protruded portions on the surface side opposite to body.

2. The fabric according to 1 mentioned above, wherein the protruded portions have a width of 100 to 2,500 μm, and a height of 30 to 300% of the width of the protruded portions.

3. The fabric according to 1 mentioned above, wherein the fabric has, on the surface side opposite to body, wavy, streaky protruded portions in one direction.

4. The fabric according to 3 mentioned above, wherein protruded portions in the wavy, streaky protruded portions have a width of 100 to 2,500 μm, a height of 15 to 300% of the width of the protruded portions, a cycle of waviness of 2,000 to 20,000 μm, and a width of the waviness of 5 to 50% of the cycle of waviness.

5. The fabric according to any one of 1 to 4 mentioned above, wherein the streaky protruded portion has micro-unevenness having a depth of 80% or less of the height of the protruded portion in the direction vertical to the streaky protruded portion.

6. The fabric according to any one of 1 to 5 mentioned above, wherein the average deviation of a surface roughness in the direction parallel to the streaky protruded portions is 5 μm or less, and the average deviation of a surface roughness in the direction vertical to the streaky protruded portions is 8 μm or less.

7. The fabric according to any one of 1 to 6 mentioned above, wherein the fabric is composed of a polyester yarn and an elastic yarn.

8. The fabric according to 7 mentioned above, wherein the fabric is a jacquard knitted fabric.

9. The fabric according to any one of 1 to 7 mentioned above, wherein the fabric has a surface layer of an elastic layer on the surface side, opposite to a body, of the fabric.

10. Sportswear for racing formed, in at least a portion thereof, out of the fabric according to any one of 1 to 9 mentioned above.

11. Swimwear formed, in at least a portion thereof, out of the fabric according to any one of 1 to 9 mentioned above.

12. The swimwear according to 11 mentioned above, wherein the fabric has streaky protruded portions arranged in the longitudinal direction of a human body.

In the present invention, the surface side, opposite to the body, of a fabric signifies a surface opposite to the wearer's body when the clothes are worn, that is, it signifies a surface side that is contacted with an external environment. For example, for swimwear, the surface side, opposite to the body, is the surface in contact with a fluid such as water.

The present invention is explained below in detail.

In general, when the surface of a fabric is smooth, that is, when the surface roughness of a fabric is small, the fluid resistance of the surface of the fabric is decreased. Moreover, the effect of decreasing the fluid resistance is enhanced by making the fluid flow smooth by providing grooves and projections to the fabric in the direction parallel to the fluid flow. However, the present inventors have found that in order to decrease the fluid resistance, the compression ratio of micro-area in the fabric surface is a very important factor in addition to the effect of decreasing the surface roughness of the fabric and the smooth flow effect obtained by providing grooves and projections.

When an object proceeds in the water or the air, eddy flows are produced around the periphery thereof, and the process thereof is hindered. However, the eddy flows are decreased and, as a result, the fluid resistance is decreased, by compression deformation of the fabric. Although the mechanism of decreasing the eddy flows is not necessarily definite, it is estimated that the dynamic behavior of fabric surface repeating compression deformation-recovery suppresses the growth of eddy flows. Because the easiness of forming micro-deformations of the fabric near the surface thereof particularly greatly influences the dynamic behavior, a fabric having a larger compression ratio of a micro-area in the fabric surface exhibits a greater effect of decreasing eddy flows.

The fabric of the present invention must therefore have a compression ratio of micro-area in the fabric surface on the surface side opposite to body of 8 to 90%.

In general, a fabric for swimwear, for example, a knitted fabric such as a two-way tricot knitted fabric formed out of a polyester yarn and a spandex yarn, or a knitted or woven fabric provided with grooves or projections to obtain a smooth flow effect has a compression ratio of micro-area in the fabric surface of less than 8%. When the compression ratio of micro-area in the fabric surface is less than 8%, deformation under pressure, namely, deformation of a fabric caused by fluid is insufficient. As a result, the effect of decreasing a fluid resistance caused by deformation is small. When the compression ratio of micro-area in the fabric surface exceeds 90%, the surface deformation becomes excessively large, and the durability of the fabric becomes poor. Moreover, when the fabric has a laminated resin film, as will be described later, the fabric has strong tucking properties for some film materials, and the handleability of the fabric during wearing sometimes becomes poor.

The fabric of the present invention shows a large compression ratio of micro-area in the fabric surface, and a large fabric surface deformation caused by fluid pressure. As a result, the fabric displays the effect of decreasing a fluid resistance not only in the flowing direction of fluid but also in all directions in accordance with the motion of the wearer's body.

Examples of the effective method of making the compression ratio of micro-area in the fabric surface fall in a range of 8 to 90% include a method of forming the fabric surface out of a soft, elastic fiber, a method of covering the fabric surface with a soft elastic resin, and a method of making the fabric surface have a special, compressible shape. These methods can be used singly or in combination. As will be described later, even for a conventional two-way knitted fabric, the compression ratio of micro-area in the fabric surface of 8 to 90% can be achieved when the fabric has an adequately compressible uneven shape. Moreover, for a fabric that has a surface formed out of an elastic material, the compression ratio can be achieved even when the uneven shape is relatively small.

The fabric of the present invention has streaky protruded portions on the surface side opposite to body of the fabric. When the fabric has streaky protruded portions, a smooth flow effect can be obtained and a compressive deformation near the fabric surface is likely take place. When the fabric is used for clothes, the streaky protruded portions are preferably arranged on the surface side of the fabric, opposite to a body, in the longitudinal direction of a human body. That is, making the streaky protrusions approximately parallel to the fluid flow direction is desirable because the fluid resistance becomes a minimum. Although the shape of the streaky protruded portions differs depending on the elasticity of a material forming the fabric and the surface shape of the fabric, the width is preferably from 100 to 2,500 μm, and more preferably from 100 to 1,500 μm.

In order to increase the compression ratio of micro-area in the fabric surface, the area of the protruded portions is 50% or less of the fabric area, more preferably 30% or less. In addition, the area of the protruded portions herein signifies an area of the widths of the protruded portions in the measured plane described below.

As explained later, the shape of protruded portions is measured with a three-dimensional shape determination system LC 2400 (manufactured by SIGMA KOKI CO., LTD.).

The width of the protruded portions is explained below. Data obtained by measurements is converted to EXCEL, and the average value of vertexes of the streaky protruded portions is obtained. The protruded portions are virtually cut with a plane 30% apart from the average value of the vertexes. The width of the protruded portions designates the average of the widths of the virtually cut out protruded portions. The height of the protruded portions signifies a distance from the plane to the average of the most recessed streaky portions.

When the protruded portions have a width of 2,500 μm or less, the effect of the protruded portions is effectively displayed because the area suffering a fluid resistance is not excessively large and is suitable. As a result, the deformation caused by compression is sufficient, and the effect of decreasing a fluid resistance becomes high in accordance with the deformation. A compression deformation is likely to take place when the protruded portions have a small width. However, when the width is extremely small, the effect of decreasing a fluid resistance is lessened because the deformation amount becomes very small. The lower limit of a width of the protruded portions is therefore preferably 100 μm.

In order to cause an effective deformation by compression, the height of the protruded portions is preferably from 30 to 300% of the width of the protruded portions, and more preferably from 60 to 250% of thereof. The absolute value of the height of the protruded portions is preferably 1,000 μm or less in view of a surface roughness to be explained later. When the height of the protruded portions is in the above range, the compression ratio of the micro-area in the fabric surface can be made to fall in the range of the invention regardless of the type of the fabric material.

In the present invention, streaky protruded portions signify not only straight linear ones but also curved ones, curved ones with waves, dotted ones, and the like. For dotted protruded portions, the size, the space, and the like, of the dots are not restricted. For example, yarns arranged in rib shape on a knitted or woven fabric are also included. Accordingly, a method of forming the above micro-unevenness with a jacquard knitting or weaving machine is appropriately used.

Although the space of the streaky protruded portions is not specifically limited, the space is preferably from 500 to 5,000 μm, and more preferably from 500 to 3,000 μm. When the space is in the above range, the smooth flow effect is effectively displayed. The space of the protruded portions designates an average of a distance (interval) between a line bisecting the width of a protruded portion (streak of the protruded portion) and a line bisecting the width of an adjacent protruded portion (streak of the protruded portion). There is no specific limitation on the slope between a protruded portion and a recessed portion. The cross section may be trapezoidal, semicircular, and the like. When the protruded portions and the recessed portions are trapezoidal, the width of a protruded portion and that of a recessed portion are preferably from 20 to 40% of the space between the recessed portion and the protruded portion.

The fabric of the invention preferably has streaky protruded portions having waviness on direction, on the surface side opposite to body, because the effect of decreasing a fluid resistance further increases. The waviness herein designates that the streaky protruded portions form corrugations in the horizontal direction. It has already been known that the streaky unevenness along a fluid flow on the surface accelerates smoothness of the fluid flow, and the fluid resistance is decreased. However, the present inventors have found that wavy, streaky protruded portions produce a more marked effect of decreasing a fluid resistance than straight, streaky protruded portions.

The mechanism of decreasing a fluid resistance is not necessarily definite, but is explained below. For straight, streaky protruded portions, the path of a fluid proceeding on the fabric is long; as a result the size of generated eddies increases to increase the fluid resistance. However, when the streaky protruded portions are made wavy, the fluid hardly proceeds on the streaky unevenness, and the size of the eddies thus produced decreases. Because the fluid resistance is known to be proportional to the square of the size of the eddies thus generated, reduction of the size of the eddies accelerates lowering the flow resistance. Moreover, when a micro-uneven surface formed by forming waviness in the streaky protruded portions is compressed by a fluid flow, variations in the directions of the fluid flow are likely to be induced in comparison with a fluid flow without waviness therein. As a result, the micro-compression of the surface can be increased.

The wavy, streaky protruded portions preferably have the following dimensions: a width of the protruded portions of from 100 to 2,500 μm; a height of the protruded portions of from 15 to 300% of the width of the protruded portions; a cycle of waviness of from 2,000 to 20,000 μm; and a width of waviness of from 5 to 50% of the cycle of waviness. The space of the streaky protruded portions is preferably from 300 to 2,500 μm, and more preferably from 500 to 2,000 μm.

When the streaky protruded portions have no waviness, the height of the protruded portions is preferably from 30 to 300% of the width of the protruded portions. On the other hand, when the streaky protruded portions have waviness, the protruded portions the height of which is from 15 to 300% of the width thereof can display the effect of decreasing a fluid resistance. The effect is produced because the size of generated eddies is decreased in comparison with the streaky protruded portions without waviness, as explained above.

The cycle of waviness designates the length of a repeating unit of the waviness in the longitudinal direction of the waves. When the cycle of waviness is in the above range, the protruded portions fully display the effect of decreasing the size of generated eddies.

The width of waviness is the amplitude of the waviness. The width is an average of a maximum amplitude in the width direction of the midpoint of the width of the streaky protruded portions. When the amplitude of the waviness is in the above range, the effect of waviness is effectively displayed, and the streaky protruded portions produce a marked effect of decreasing a fluid resistance in the direction parallel to fluid flows. In addition, the cycle and width of waviness are not necessarily required to be constant. The cycle and width may vary, and various cycles and widths may be present in the fabric in a mixture.

The fabric of the invention preferably has a micro-unevenness the depth of which is 80% or less of the height of the protruded portion in the vertical direction of the streaky protruded portion, namely, in the height direction thereof, because the effect of decreasing a flow resistance can be further enhanced. In this case, the streaky protruded portions are still more preferred when they are wavy, streaky protruded portions. When the fabric has microprotruded portions having a depth of 80% or less of the height of a streaky protruded portion in the direction vertical to the streaky one, namely, in the direction making an angle of approximately 80 to 100 degrees, the fabric achieves a further enhanced effect of decreasing a flow resistance in comparison with a fabric having a streaky protruded portion in one direction alone.

That the fabric has a micro-unevenness having a depth of 80% or less of the height of a streaky protruded portion in the direction vertical to the streaky one signifies (in other words) that the height of the protruded portion in the streaky one varies in the longitudinal direction. A depth of micro-unevenness signifies a difference between a maximum value and a minimum value of a height or the protruded portion, namely, a variation width of a protruded portion height. A depth of micro-unevenness is more preferably from 20 to 80% of the height of the protruded portion. Moreover, the following are preferred: micro-unevenness is cyclically present; the cycle of micro-unevenness, namely, a distance from a point where the height of the streaky protruded portion becomes minimum to a point where the height thereof subsequently becomes minimum is from 80 to 200% of a space of streaky protruded portions, namely, from 80 to 200% of a distance from the streaky protruded portion to the adjacent streaky protruded portion.

As explained above, the mechanism of decreasing a fluid resistance by providing unevenness in the two directions is not necessarily definite. However, the mechanism is explained below. For the fabric having protruded portions in one direction alone, eddies are produced in a recessed portion between two protruded portions adjacent to each other, when fluid flows in the direction vertical to the protruded portions. A fluid resistance therefore increases in comparison with a fabric having a smooth surface. In contrast to the above case, a fabric having streaky unevenness in two directions is inferred to manifest a smooth flow effect on a water flow in each direction to enhance the effect of decreasing a flow resistance. In addition to the above inference, the following is inferred. When a fabric is provided with streaky unevenness in the two directions, the protruded portions are likely to be deformed by fluid, and a decrease in the fluid resistance is accelerated by the deformation in comparison with a fabric having a streaky unevenness in one direction.

Examples of an appropriate method of providing a fabric with streaky protruded portions include a method comprising preparing a woven or knitted fabric, or the like, with a jacquard machine so that an uneven shape is imparted, a method comprising partially stacking part of the yarn of a knitted fabric such as a smooth knitted fabric or a half-tricot knitted fabric so that protruded portions are provided; and a method comprising forming an uneven pattern on a fabric with an emboss roll having a carved pattern. Although the embossing temperature differs depending on a material, the embossing temperature of the mixed knitted fabric of a polyester and a polyurethane is preferably from 160 to 180° C. Moreover, for a fabric having a laminated elastic layer to be described later, a method of imparting protruded portions to a fabric after the lamination with an emboss roll having a curved uneven pattern. For a urethane resin, the embossing temperature is preferably from 120 to 150° C., because the compression properties of the micro-area in the fabric surface are not changed with heat. A method comprising preparing an elastic layer composed of a film of a resin such as a urethane resin with a releasing paper having an uneven pattern, and sticking the elastic layer to a gray fabric by lamination, or the like procedure makes the film surface softer. The fabric subsequent to lamination is very preferred because the fabric shows a large compression ratio of micro-area in the fabric surface.

When the surface roughness of the fabric is excessively large, the fluid resistance on the fabric surface is likely to increase due to a large surface roughness. In order to decrease the fluid resistance on the fabric surface, the average deviation of the surface roughness on the fabric surface is desirably 5 μm or less in the direction parallel to the streaky protruded portions, and the average deviation of the surface roughness is desirably 8 μm or less in the direction vertical to the streaky protruded portions.

Because fluid mainly flows in the longitudinal direction of a human body during wearing, a direction parallel to the streaky protruded portions becomes the longitudinal direction of the clothes. The surface roughness in this direction is desirably small. In order to make the surface roughness fall in the preferred range, protruded portions having a height of 100 to 1,000 μm are preferably formed by weaving or knitting stitch, laminating, embossing, or the like procedure. When the tip of a protruded portion is smoothed while the protruded portion has a protruded streak by calendaring, the fabric has a marked effect of decreasing fluid resistance. However, in order to maintain a predetermined compression ratio of micro-area in the fabric surface, attention must be paid not to excessively heat the fabric. A method of providing a recessed portion by partially drawing part of the yarn during knitting, or a method of providing a recessed portion with deep embossing is not preferred because the surface roughness increases to increase the fluid resistance.

The average deviation of a surface roughness is determined by the following procedure: using a surface tester (trade name of KES-FB4, manufactured by Kato Tech Co., Ltd.), a contact probe 5 mm wide composed of a piano wire 0.5 mm in diameter is press contacted with a sample with a weight of 5 gf to which a uniaxial tension of 29.4 cN is applied, and measurements are made while the sample is being horizontally moved for 2 cm at a constant speed of 0.1 cm/sec.

The average deviation of surface roughness (SMD) is represented by the formula (1):

$$SMD = (1/x) \times \int_0^x |T_X - T_A| \quad (1)$$

wherein x is a position, $T_x$ is a thickness (measured by the contact probe) at x of the sample, and $T_A$ is an average of T.

The fabric of the invention preferably has a surface layer of an elastic layer on the surface side opposite to body. The elastic layer preferably shows a compression ratio of a micro-area in the fabric surface of 20 to 95%. When the compression ratio of micro-area in the fabric surface of the elastic layer is from 20 to 95%, a fabric having the elastic layer formed by lamination can be made to show a compression ratio of micro-area in the fabric surface of 8 to 90%. Moreover, the thickness of the elastic layer is preferably from 30 to 500 μm, and more preferably from 300 to 500 μm.

A resin film showing a surface compression ratio of a resin (film thickness of 300 μm) of 20 to 95% is preferred as an elastic layer. Although there is no specific restriction on the type of a resin forming the elastic layer, a polyurethane resin, an acrylate resin, and the like are appropriately used.

A fabric can be made to show a compression ratio of micro-area in the fabric surface of 8 to 90% by preparing the fabric with lamination of an elastic layer. For physical properties of the fabric prepared by lamination of an elastic layer composed of a resin film, the tenacity at 80% elongation determined by the following procedure is preferably 2.9 N or less: a test piece 2.5 cm wide of the sample is stretched with a chuck-to-chuck distance of 10 cm at a pulling speed of 300 mm/min. When the above tenacity is 2.9 N or less, the stretchability of the fabric is not hindered.

There is no specific limitation on a yarn forming the fabric in the present invention, and any freely selected yarn can be used. Examples of the yarn include a multifilaments yarn of a polyester such as a poly(ethylene terephthalate), a poly(trimethylene terephthalate) and a poly(butylene terephthalate), a polyamide multifilaments yarn, a polypropylene multifilaments yarn and a polyurethane multifilaments yarn. One type of filaments yarn or various types of filaments yarns can be employed.

Although there is no specific limitation on a total size and a single filament size of the yarn, a total size of 33 to 167 dtex, and a single filament size of 0.5 to 5 dtex are preferred. There is no specific restriction on a cross-sectional shape of the yarn, and a freely selected shape is employed. A yarn having a circular cross-section, a triangular cross-section, a W-shaped cross-section, a hollow cross-section, or the like cross-section is preferred.

A knitted fabric or a woven fabric may be used as the fabric. However, when the fabric is used for sportswear, a knitted fabric or a woven fabric rich in stretchability is preferred in order to impart stretchability thereto. A mixed knitted fabric formed by mixed knitting a polyester yarn and an elastic yarn is more preferred. Examples of the elastic yarn include a polyurethane yarn, a poly(trimethylene terephthalate) yarn and a poly(butylene terephthalate) yarn. For a woven or knitted structure, the fabric is preferably a jacquard woven or knitted fabric to which an uneven shape is imparted as described above, or a knitted fabric such as a smooth knitted fabric or a half tricot knitted fabric provided with protruded portions is preferred. The knitted or woven fabric may be provided with a resin layer on the surface as described above.

The fabric of the invention may be used for the entire clothes, or it may be freely used in a desired site in accordance with the application of the clothes. For example, when the fabric is used for swimwear, in particular, for swimwear for racing, the fabric is preferably used in a surface area of 30% or more of the entire clothes in order to reduce water resistance. The fabric is particularly preferably used in the bust portion, the buttock portion, and the like portion susceptible to a flowing water resistance. Moreover, for example, the fabric is preferably used in the entire portion of the bust and the femoral region when air resistance is applied to clothes such as an athletic shirt and trunks, and is more preferably used for the entire clothes.

The fabric of the present invention shows a decreased resistance to water and air even when fluid flow directions are variously changed. The fabric is therefore appropriately used for sportswear for track and field events, skiing, particularly for ski jumping racing. The fabric is not restricted to these applications alone.

BEST MODE FOR CARRYING OUT THE INVENTION

The present invention is specifically explained below by making reference to examples.

Evaluations in the present invention are made by the following methods.

(1) Compression Ratio of Micro-Area in a Surface of a Fabric and a Resin

Using a microcompression testing machine (manufactured by Shimadzu Corporation, and the like), measurements are made under the following conditions: a maximum load of 98 mN; a minimum load of 4.9 mN; a diameter of a probe of 500 μm; and a compression rate of 7.7 mN/sec.

A sample, 5 cm×5 cm, is allowed to stand still. A protruded portion is randomly selected, and the center of the probe is made to conform to the center of the width of the protruded portion, followed by making a measurement. The measurement site is changed, and a measurement is made (n=10). An average of the measured values is determined (for a fabric having no protruded portions, measurement sites are randomly selected). The compression ratio (EMC) of micro-area in a surface is determined from the following formula:

$$\text{compression ratio (\%) of micro-area in a surface}=(L1/d)\times 100$$

wherein L1 (μm)=(displacement under a maximum load)−(displacement under a minimum load), and d is a diameter (μm) of the probe.

(2) Shape of Protruded Portions

Measurements are made with a three-dimensional shape determination system (trade name of LC 2400, manufactured by Sigma Koki Co., Ltd.). A sample, 5 cm×5 cm, is allowed to stand still so that the sample has neither curls nor strains. Measurements are made in an area of 3,000 μm×3,000 μm or more, at a measurement interval of 20 μm, and data of heights at respective measurement points are obtained.

(3) Fluid Resistance

Measurements are made in accordance with a method described in Example 1 "method of measuring a fluid resistance of a fabric and an apparatus therefor" in Japanese Unexamined Patent Publication (Kokai) No. 7-63749.

An acrylic circular tube 3 cm in diameter and 1.5 m long having a branched tube at a site 30 cm apart from the top is placed at an inclination of 15 degrees as a tilting flow path. Water from a water line is allowed to flow at a flow rate of 70 liter/min. Two semispherical silicone rubber-made caps are attached to both ends, respectively, of an aluminum circular tube (apparent specific gravity of 0.68 g/cm$^3$) 1.6 cm in diameter and 16 cm long. A sample is wound around an adapter which is at one end of the aluminum tube and to which a polyester monofilament yarn 120 cm long having a size of 150 denier (167 dtex) has been attached. The aluminum tube is positioned within the acrylic circular tube, and measurements are made.

A push-pull gauge (manufactured by Aiko Engineering Co., Ltd.) is used as a tension measurement apparatus, and attached to a polyester monofilament yarn. A sample, 4.5 cm×14.5 cm, is prepared by cutting a fabric. The sample is stitched to form a tubular shape. An adapter is covered with the sample, and an adhesive tape is wound around both ends of the sample to fix the sample.

EXAMPLE 1

A fabric having a pattern of wavy, streaky protruded portions was prepared with a 28-gauge jacquard knitting machine. A polyester yarn composed of a poly(ethylene terephthalate) and having a size of 33 dtex/36 filaments was supplied in the front yarn guide of the knitting machine. A polyester yarn composed of a poly(ethylene terephthalate) and having a size of 56 dtex/36 filaments was supplied in the middle yarn guide of the knitting machine. A spandex yarn having a size of 44 dtex was supplied in the back yarn guide of the knitting machine (blending ratio: 40% by weight in the front portion; 48% by weight in the middle portion; and 12% by weight in the back portion). The fabric was conventionally finished, and the shape of protruded portions of the kitted fabric was measured. The following results were then obtained: a width of 350 μm; a height of 450 μm; a space of 1,800 μm (streaky protruded portions); and a cycle of waviness of 6,500 μm and a width of waviness of 1,600 μm.

The compression ratio of micro-area in the fabric surface was 28%.

Measurements of a fluid resistance were made on swimwear having been prepared from the fabric so that the protruded portions were in parallel to the longitudinal direction of a human body. Table 1 shows the results. In Table 1, a fluid resistance is a value obtained by subtracting a tension of 65 g obtained when the fabric was not attached from a measured value when the fabric was attached. The results are shown under the titles of "longitudinal", "lateral" and "45 degrees". In addition, "longitudinal" herein represents the longitudinal direction of the swimwear, that is, it represents a case wherein the direction of the streaky protruded portions is parallel to the water flow direction; "lateral" herein represents a case wherein the direction of the streaky protruded portions is vertical to the water flow direction; and "45 degrees" herein represents a case wherein the longitudinal direction of the fabric makes an angle of 45 degrees with the water flow direction.

It is understood from the results that the fabric obtained in Example 1 is a fabric showing a low fluid resistance.

EXAMPLE 2

The jacquard knitted fabric obtained in Example 1 was calendared at 180° C. to give a fabric having streaky protruded portions. Measurements were made on the fabric in the same manner as in Example 1. Table 1 shows the results.

The shape of the protruded portions was as follows: a width of 350 μm; a height of 230 μm; a space of 1,800 μm (streaky protruded portions); and a cycle of waviness of 6,500 μm and a width of waviness of 1,600 μm.

Moreover, the compression ratio of micro-area in the fabric surface was 12.5%. The fabric showed a still lower fluid resistance due to the smoothing effect of the fabric surface.

EXAMPLE 3

A releasing paper having the following pattern of streaky protruded portions was prepared: a width of 200 μm; a height of 300 μm; and a space of 650 μm. Using the releasing paper, an uneven film was formed out of a polyurethane resin (prepared by adding 2% by weight of Crisvon Assitor SD 27 to Crisvon NYT-20, both being trade names and manufactured by DAINIPPON INK AND CHEMICALS, INC.) containing DMF as a solvent, by an autocoater with a clearance of 200 μm. In addition, the film was dried at 80° C. for 2 minutes.

The 300 μm thick film thus obtained showed a surface compression ratio of 45%.

The uneven film thus obtained was laminated to a 32-gauge two-way tricot knitted fabric formed out of 76% by weight of a polyester yarn that was composed of poly(ethylene terephthalate) and had a size of 56 dtex/36 filaments and 24% by weight of a spandex yarn that had a size of 44 dtex to give a fabric having a surface layer of an elastic layer. In addition, during lamination, the streaky unevenness was made to conform to the longitudinal direction of the knitted fabric, and both were bonded with an adhesive (a solution of Crisvon 4070 (trade name, manufactured by DAINIPPON INK AND CHEMICALS, INC.) in toluene).

The fabric having a surface layer of an elastic layer was used as a sample, and measurements were made in the same manner as in Example 1. Table 1 shows the results.

The shape of the protruded portions was as follows: a width of 210 μm; a height of 250 μm; and a space of 650 μm (streaky protruded portions). Moreover, the fabric showed a compression ratio of micro-area in the fabric surface of 25%, a low fluid resistance, and sufficient stretchability.

EXAMPLE 4

A fabric having a surface layer of an elastic layer was prepared in the same manner as in Example 3 except that a releasing paper having a pattern of micro-protruded portions that had waviness in the direction vertical to the streaky protruded portions with a cycle of 10,000 μm and a width of 1,200 μm was used. The fabric having a surface layer of an elastic layer was used as a sample, and measurements were made in the same manner as in Example 1. Table 1 shows the results.

The shape of the protruded portions was as follows: a width of 210 μm; a height of 250 μm; a space of 650 μm (streaky protruded portions); and a cycle of waviness of 10,000 μm and a width of waviness of 1,200 μm.

The fabric showed a compression ratio of micro-area in the fabric surface of 36%, a very small flowing water resistance in any of the flowing directions in the longitudinal, lateral and 45 degrees directions, and sufficient stretchability.

EXAMPLE 5

A fabric having a surface layer of an elastic layer was prepared in the same manner as in Example 4 except that a releasing paper having a pattern of micro-protruded portions that had, in the direction vertical to the streaky protruded portions, a height of 50 μm and a space of 1,350 μm was used. The fabric having a surface layer of an elastic layer was used as a sample, and measurements were made in the same manner as in Example 1. Table 1 Shows the Results.

The shape of the protruded portions was as follows: a width of 210 μm; a height of 250 μm; a space of 650 μm (streaky protruded portions); a cycle of waviness of 10,000 μm and a width of waviness of 1,200 μm; and micro-unevenness in the direction vertical to the streaky protruded portions with a height of 50 μm and a space of 1,350 μm. The fabric showed a compression ratio of micro-area in the fabric surface of 42%, a very small flowing water resistance in any of the flowing directions in the longitudinal, lateral and 45 degrees directions, and sufficient stretchability.

EXAMPLE 6

The two-way tricot knitted fabric used in Example 3 was embossed with a protruded portion pattern having a width of protruded portions of 200 μm, a height of 150 μm and a space of 550 μm to give a fabric. Table 1 shows the results of evaluating the fabric thus obtained.

The shape of the fabric was as follows: a width of 200 μm; a height of 90 μm; and a space of 550 μm (streaky protruded portions). Moreover, the fabric showed a compression ratio of micro-area in the fabric surface of 8.5%.

EXAMPLE 7

The two-way tricot knitted fabric used in Example 3 was embossed to give a fabric. The pattern of the emboss roll used for embossing was the same protruded pattern having waviness as that of the releasing paper used in Example 4 except that the protruded portions were dotted, and had a width of 250 μm, a length of 400 μm and a space in the longitudinal direction of 500 μm.

Table 1 shows the results of evaluating the fabric thus obtained.

The shape of the protruded portions was as follows: a width of 210 μm; a height of 250 μm; a space of 650 μm (streaky dots); and a cycle of waviness of 10,000 μm and a width of waviness of 1,200 μm. Moreover, the fabric showed a compression ratio of micro-area in the fabric surface of 40%, a very small flowing water resistance in any of the flowing directions in the longitudinal, lateral and 45 degrees directions, and sufficient stretchability.

COMPARATIVE EXAMPLE 1

A fabric having streaky protruded portions was obtained in the same manner as in Example 1 except that the jacquard knitted fabric having been used in Example 1 was used, and that the pattern of protruded portions was altered. Table 1 shows the results of evaluating the fabric thus obtained.

The shape of the protruded portions was as follows: a width of 3,000 μm; a height of 300 μm; a space of 3,000 μm (streaky protruded portions); and a cycle of waviness of 10,000 μm and a width of waviness of 4,000 μm. Moreover, the fabric showed a compression ratio of micro-area in the fabric surface of 7%.

COMPARATIVE EXAMPLE 2

The tricot knitted fabric used in Example 3 was not treated, and used as a sample. Table 1 shows the results of evaluating the sample.

COMPARATIVE EXAMPLE 3

The tricot knitted fabric used in Example 3 was treated in the same manner as in Example 3 with a releasing paper without unevenness to give a fabric. Table 1 shows the results of evaluating the fabric.

COMPARATIVE EXAMPLE 4

A fabric was obtained in the same manner as in Example 6 except that the protruded portions had a width of 650 μm, a height of 200 μm and a space of 800 μm. Table 1 shows the results of evaluating the fabric thus obtained.

COMPARATIVE EXAMPLE 5

A fabric was obtained in the same manner as in Example 3 except that a polyurethane film 300 μm thick showing a compression ratio of 97% was used. Table 1 shows the results of evaluating the fabric thus obtained.

The fabric has remarkable tucking properties, sticks together when the fabric was folded, and showed poor handleability.

It is understood from the results in Table 1 that the fabrics of the present invention (Examples 1 to 7) show decreased fluid resistance. In contrast to the fabrics of the invention, it is understood that the fabrics of Comparative Examples 1 to 4 show increased fluid resistance and that the fabric in Comparative Example 5 shows poor handleability.

TABLE 1

| | Streaky protruded portions (μm) | Waviness (μm) | Surface roughness (μm) | | Compression ratio of micro-area in a surface | Fluid resistance (g) | | | |
|---|---|---|---|---|---|---|---|---|---|
| | Width*height*space | Cycle*width | Lo+ | La+ | (%) | Lo+ | La+ | 45 deg+ | Note |
| Ex. 1 | 250*230*1800 | 6500*1600 | 4.4 | 6.1 | 28 | 19 | 27 | 24 | |
| Ex. 2 | 350*230*1800 | 6500*1600 | 1.8 | 2.2 | 12.5 | 17 | 23 | 22 | |
| Ex. 3 | 210*250*650 | — | 0.6 | 4.2 | 25 | 22 | 32 | 29 | |
| Ex. 4 | 210*250*650 | 10000*1200 | 0.8 | 3.2 | 36 | 17 | 22 | 23 | |
| Ex. 5 | 210*250*650 | 10000*1200 | 1.3 | 3 | 42 | 16 | 15 | 14 | Unevenness formed in two directions |
| Ex. 6 | 200*90*550 | — | 0.8 | 2.5 | 8.5 | 23 | 33 | 30 | |
| Ex. 7 | 210*250*650 | 10000*1200 | 4.7 | 7.7 | 40 | 22 | 29 | 28 | Dotted |
| C. Ex. 1 | 3000*300*3000 | 10000*4000 | 5.5 | 8 | 7 | 38 | 42 | 39 | |
| C. Ex. 2 | — | — | 3.7 | 2.7 | 6 | 40 | 48 | 44 | |
| C. Ex. 3 | — | — | 1.1 | 1.8 | 7 | 29 | 32 | 35 | |
| C. Ex. 4 | 600*150*800 | — | 1.5 | 1.5 | 6 | 36 | 45 | 41 | |
| C. Ex. 5 | 150*200*650 | — | 1.6 | 4.9 | 92 | 18 | 27 | 23 | Poor handleability |

Note:
+: Lo = Longitudinal, La = Lateral, 45 deg = 45 degrees

INDUSTRIAL APPLICABILITY

The fabric of the present invention shows a decreased resistance to a flow of water and air, and it does so even when fluid flow directions are variously changed. The fabric of the present invention is therefore particularly suited to the field of sportswear for racing, and can be appropriately used for, for example, sportswear for swimwear for racing, sportswear for track and field events and sportswear for skiing, and particularly for sportswear for ski jumping.

The invention claimed is:

1. A sportswear for an athlete comprising sportswear, made at least in part, from a fabric having a fabric surface and a compression ratio of a micro-area in the fabric surface on a surface side opposite to the body of a wearer of the sportswear of from 8 to 90%, and having protruded portions on the surface side opposite to the wearer's body, wherein the protruded portions are wavy and streaky and have a width of 100 to 2,500 μm, a height of 15 to 300% of the width of the protruded portions, a cycle of waviness of 2,000 to 20,000 μm, and a width of the waviness of 5 to 50% of the cycle of waviness.

2. The sportswear according to claim 1, wherein the streaky protruded portions have micro-unevenness having a depth of 80% or less of the height of the protruded portions in a direction vertical to the streaky protruded portions.

3. The sportswear according to claim 1, wherein the average deviation of a surface roughness in a direction parallel to the streaky protruded portions is 5 μm or less, and the average deviation of a surface roughness in a direction vertical to the streaky protruded portions is 8 μm or less.

4. The sportswear according to claim 1, wherein the fabric is composed of a polyester yarn and an elastic yarn.

5. The sportswear according to claim 1, wherein the fabric is a jacquard knitted fabric.

6. The sportswear according to claim 1, wherein the fabric has a surface layer of an elastic layer on the surface side, opposite to the wearer's body, of the fabric.

7. The sportswear according to claim 1, wherein the sportswear is swimwear made in at least a portion thereof, out of the fabric.

8. The sportswear according to claim 7, wherein the fabric of the swimwear has the streaky protruded portions arranged in the longitudinal direction of the wearer's body.

9. The sportswear according to claim 1, wherein the protruded portions have a height of 60 to 250% of the width of the protruded portions.

10. The sportswear according to claim 1, wherein an area of the protruded portions is 30% or less of an area of the fabric.

11. The sportswear according to claim 4, wherein the fabric has protruded portions provided by a method comprising partially stacking part of the yarn of a knitted fabric.

12. The sportswear according to claim 11, wherein the knitted fabric is a smooth knitted fabric or a half-tricot knitted fabric.

13. The sportswear according to claim 4, wherein the fabric has protruded portions provided with an emboss roll after the fabric is laminated with the elastic layer.

* * * * *